US007356397B2

(12) United States Patent
Porter

(10) Patent No.: US 7,356,397 B2
(45) Date of Patent: Apr. 8, 2008

(54) CROWD CONTROL SYSTEM FOR A LOADER

(75) Inventor: Thomas Alan Porter, Durango, IA (US)

(73) Assignee: Deere & Company, Moline, IL (US)

( * ) Notice: Subject to any disclaimer, the term of this patent is extended or adjusted under 35 U.S.C. 154(b) by 759 days.

(21) Appl. No.: 10/868,154

(22) Filed: Jun. 15, 2004

(65) Prior Publication Data

US 2005/0278100 A1 Dec. 15, 2005

(51) Int. Cl.
*G06F 7/70* (2006.01)

(52) U.S. Cl. ..... 701/50; 701/49; 172/4.5; 172/9

(58) Field of Classification Search ..... 701/49, 701/50; 172/4, 4.5, 9–12
See application file for complete search history.

(56) References Cited

U.S. PATENT DOCUMENTS

| | | | | |
|---|---|---|---|---|
| 3,583,243 | A | 6/1971 | Wilson | 74/15.84 |
| 3,749,269 | A | 7/1973 | Conrad | 214/762 |
| 3,796,336 | A | 3/1974 | Ratliff | 214/762 |
| 3,831,726 | A | 8/1974 | Woody et al. | 192/103 |
| 3,905,501 | A | 9/1975 | Leroux | 214/762 |
| 4,015,482 | A | 4/1977 | Ito et al. | 74/15.84 |
| 4,776,751 | A | 10/1988 | Saele | 414/699 |
| 5,040,648 | A | 8/1991 | Mitchell et al. | 192/3.58 |
| 5,613,581 | A | 3/1997 | Fonkalsrud et al. | 192/3.23 |
| 5,787,787 | A | 8/1998 | Kim et al. | 91/361 |
| 5,947,242 | A | 9/1999 | Creger | 192/3.23 |
| 6,076,612 | A * | 6/2000 | Carr et al. | 172/7 |
| 6,162,146 | A | 12/2000 | Hoefling | 477/73 |

* cited by examiner

*Primary Examiner*—Gertrude A. Jeanglaude

(57) ABSTRACT

A work vehicle comprising a motor, a drive unit for driving a ground engaging portion, a torque converter for variably transferring power from the motor to the ground engaging portion, a lubrication circuit for providing lubrication fluid to the torque converter, and a control valve located between the torque converter and the lubrication circuit. The work vehicle further having a linkage for performing a work function, an actuator to controllably move the linkage, a sensor coupled to the actuator to sense a force opposing the actuator, and a controller in communication with the sensor and the control valve. The controller is adapted to command a crowd reduction in response to the sensed force opposing the linkage, whereby the pressure of the lubrication fluid provided to the torque converter is reduced.

32 Claims, 1 Drawing Sheet

CROWD CONTROL SYSTEM FOR A LOADER

FIELD OF THE INVENTION

The present invention relates to a system for automatically reducing crowd force against loader linkage actuators during a loading operation by reducing the motive power transferred through a torque converter.

BACKGROUND OF THE INVENTION

Loaders are used to lift and move bulk materials. A loader comprises a self-propelled vehicle having a loader linkage and associated actuators for controllably moving the loader linkage. Such loaders may be provided with wheels or endless tracks for propulsion. A typical work cycle for a loader involves loading material from a pile into the loader bucket, then moving the vehicle to dump the material at a new location, and then repeating. During the bucket loading operation, it is customary for the loader boom be lowered and for the loader bucket to be driven into the pile by the forward movement of the vehicle.

The motive force of the vehicle acting on the pile during this operation generates a crowd force against the loader linkage, increasing the actuator force required to raise the loader linkage and subsequently increasing the cycle time. If sufficiently high, the crowd force may overpower the linkage actuators, preventing upward movement of the loader linkage altogether. In this situation, the operator is required to manually reduce the vehicle motive force in order to reduce crowd on the loader linkage, further increasing cycle time. The increased cycle time and operator effort attributed to crowd force diminishes overall productivity.

A number of mechanisms and systems have been used to limit crowd force in loaders and similar machines. Examples that control crowd force reduction by sensing resistance of upward movement of the loader linkage and then reducing power output are disclosed in U.S. Pat. Nos. 3,749,269 and 4,776,751. Various additional examples that control crowd force reduction by coupling the hydraulic lift and tilt circuits of the loader linkage to the drive train to reduce power output are disclosed in U.S. Pat. Nos. 3,583,243, 3,796,336, and 4,015,482.

SUMMARY OF THE INVENTION

It is an object of the present invention to provide an improved crowd control system for a loader equipped with a torque converter. More specifically, the present invention automatically reduces crowd force against the loader linkage actuators during a loading operation by reducing the motive power transferred through the torque converter.

The torque converter is supplied with lubrication fluid by a lubrication circuit, typically the lubrication system of the transmission. The lubrication fluid is utilized by the torque converter to transfer power from the engine to the transmission. By controlling the supply of lubrication fluid to the torque converter when crowd force is undesired, the magnitude of power that the torque converter is able to transfer can be reduced, thereby reducing crowd on the loader linkage. The illustrated embodiment makes use of a proportional control valve connected in the return flow of the lubrication fluid between the lubrication circuit and the torque converter to control lubrication fluid flow for this purpose.

In the illustrated embodiment, the actuators comprise hydraulic cylinders coupled to a hydraulic circuit that supplies and controls the flow of hydraulic fluid to and from the hydraulic cylinders. A pressure sensor is utilized to sense the pressure of the hydraulic fluid supplied to the hydraulic cylinders. When the pressure sensed exceeds a predetermined value, a controller is adapted to command a power crowd reduction whereby the proportional control valve reduces the pressure of the lubrication fluid provided to the torque converter in response to the pressure of the hydraulic fluid supplied to the hydraulic cylinders.

DETAILED DESCRIPTION

Figure 1:
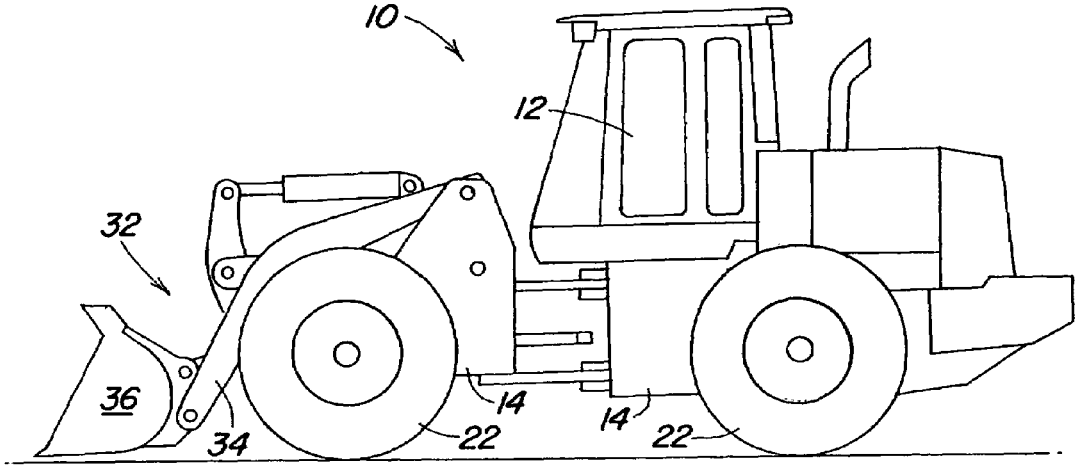
FIG. 1 is a side view of a loader.

FIG. 1 illustrates a self-propelled work vehicle, such as a loader 10. An operator controls the functions of the vehicle from an operator's station 12. The loader 10 has a frame 14, and an engine 16 that powers the vehicle. The engine 16 powers a drive unit 18 comprising a transmission 20 connected to ground engaging wheels 22 that support and propel the vehicle. Although the present invention is illustrated as being used on a loader 10 with ground engaging wheels 22 as ground engaging portions, it could also be used on loaders having ground engaging belts or tracks as the ground engaging portions.

Figure 2:
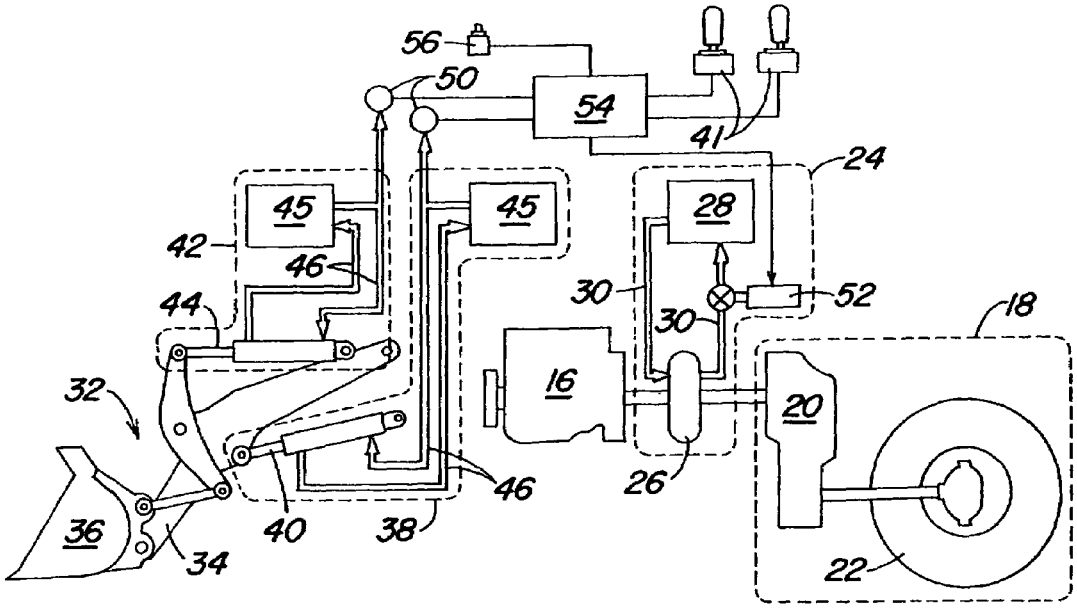
FIG. 2 is a schematic diagram of an automatic crowd control system for a loader having a torque converter.

In the embodiment illustrated in FIG. 2, a fluid coupling 24 couples the engine 16 and the transmission 20 to one another. More specifically, the fluid coupling 24 in the illustrated embodiment includes a torque converter 26. The torque converter 26 is supplied with lubrication fluid 30 by a lubrication circuit 28. The lubrication fluid 30 is utilized by the torque converter 26 to transfer power from the engine 16 to the transmission 20. Changing the supply of lubrication fluid 30 to the torque converter 26 thereby changes the magnitude of power that the torque converter 26 is able to transfer.

Attached to the front of the vehicle is a loader linkage 32 for performing a variety of excavating and material handling functions. The loader linkage 32 comprises a loader boom 34 and a tool such as a loader bucket or other structure 36. A boom actuator 38, having a boom hydraulic cylinder 40 extending between the vehicle frame 14 and the loader boom 34, controllably moves the loader boom 34 relative to the vehicle frame 14. A bucket actuator 42, having a bucket hydraulic cylinder 44 extending between the loader boom 34 and the loader bucket 42, controllably moves the loader bucket 42 relative to the loader boom 34. In the illustrated embodiment, the boom hydraulic cylinder 40 and the bucket hydraulic cylinder 44 are coupled to a hydraulic circuit 45 that supplies and controls the flow of hydraulic fluid 46 to each hydraulic cylinder.

The operator commands movement of the loader linkage 32 by manipulating a command input device 41. The hydraulic circuit 45 responds to manipulation of the command input device 41 by controlling the flow of hydraulic fluid 46 to and from the boom hydraulic cylinder 40 and the bucket hydraulic cylinder 44, causing the loader linkage 32 to move accordingly.

A typical work cycle for a loader 10 involves loading material from a pile into the loader bucket 36, then moving the vehicle to dump the material at a new location, and then repeating. Time is of the essence for peak cycle productivity. During the bucket loading operation, it is customary for the loader boom 34 to be lowered and for the loader bucket 36 to be driven into the pile by the forward movement of the vehicle.

The motive force of the vehicle acting on the pile during this operation generates a crowd force against the loader linkage 32, increasing the actuator force required to raise the loader linkage and subsequently increasing the cycle time. If sufficiently high, the crowd force may overpower the boom actuator 38 and bucket actuator 42, preventing upward movement of the loader linkage 32 altogether. In this situation, the operator is required to manually reduce the vehicle motive force in order to reduce crowd on the loader linkage 32, further increasing cycle time. The increased cycle time and operator effort attributed to crowd force diminishes overall productivity.

FIG. 2 illustrates an improved crowd control system for a loader 10 equipped with a torque converter 26. The crowd control system is adapted to automatically reduce crowd force against a loader linkage 32 during a loading operation by reducing the motive power transferred through the torque converter 26 from the engine 16 to the transmission 20.

The illustrated embodiment makes use of a pressure sensor 50 connected to the hydraulic circuit 45, a proportional control valve 52 connected in the return flow of the lubrication fluid 30 between the lubrication circuit 28 and the torque converter 20, and a controller 54 in communication with the pressure sensor 50 and the control valve 52. The pressure sensor 50 is adapted for sensing the pressure of the hydraulic fluid 46 supplied to the boom hydraulic cylinder 40 or the bucket hydraulic cylinder 44. When the pressure sensed exceeds a predetermined value, the controller 54 is adapted to command a power crowd reduction whereby the proportional control valve 52 reduces the pressure of the lubrication fluid 30 provided to the torque converter 26 in response to the pressure of the hydraulic fluid 46. By reducing the pressure of the lubrication fluid 30, the power that the torque converter 26 is able to absorb is reduced, thereby reducing motive power transferred from the engine 16 to the transmission 20.

In the illustrated embodiment, the command input device 41 is in communication with the controller 54, and the controller 54 is precluded from commanding a power crowd reduction unless the command input device 41 is in a work position. The illustrated embodiment also utilizes an activation switch 56 in communication with the controller 54, wherein the controller 54 is also precluded from commanding a power crowd reduction unless the activation switch 56 is engaged.

Having described the illustrated embodiment, it will become apparent that various modifications can be made without departing from the scope of the invention as defined in the accompanying claims.

The invention claimed is:

1. A work vehicle comprising:

a frame;

a motor supported by the frame;

a drive unit having a transmission operatively coupled with a ground engaging output portion to support and propel the frame;

a fluid coupling driving the ground engaging output portion, adapted for controllably transferring motive power from the motor to the transmission;

a linkage movably attached to the frame to perform a work function;

an actuator adapted to controllably move the linkage;

a sensor coupled to the actuator to sense a force opposing the actuator;

a controller in communication with the sensor and the fluid coupling, adapted to command a crowd reduction whereby the fluid coupling controllably reduces motive power transferred from the motor to the transmission in response to the force opposing the actuator.

2. A work vehicle defined in claim 1 wherein the transmission is a mechanical transmission.

3. A work vehicle defined in claim 1 wherein the fluid coupling comprising:

a torque converter driving the ground engaging output portion, adapted for variably transferring motive power from the motor to the transmission;

a lubrication circuit for providing lubrication fluid to the torque converter;

a control valve fluidly coupled between the torque converter and the lubrication circuit, adapted to controllably reduce the pressure of the lubrication fluid provided to the torque converter thereby reducing motive power transferred from the motor to the transmission.

4. A work vehicle defined in claim 1 comprising a command input device in communication with the controller, wherein the actuator controllably moves the linkage in proportion to operator manipulation of the command input device, and wherein the controller is precluded from commanding a crowd reduction unless the command input device is in a work position.

5. A work vehicle defined in claim 4 comprising an activation switch in communication with the controller, wherein the controller is precluded from commanding a crowd reduction unless the activation switch is engaged.

6. A work vehicle defined in claim 1 comprising an activation switch in communication with the controller, wherein the controller is precluded from commanding a crowd reduction unless the activation switch is engaged.

7. A work vehicle defined in claim 3 comprising a command input device in communication with the controller, wherein the actuator controllably moves the linkage in proportion to operator manipulation of the command input device, and wherein the controller is precluded from commanding a crowd reduction unless the command input device is in a work position.

8. A work vehicle defined in claim 7 comprising an activation switch in communication with the controller, wherein the controller is precluded from commanding a crowd reduction unless the activation switch is engaged.

9. A work vehicle defined in claim 3 comprising an activation switch in communication with the controller, wherein the controller is precluded from commanding a crowd reduction unless the activation switch is engaged.

10. A work vehicle comprising:

a frame;

a motor supported by the frame;

a drive unit having a transmission operatively coupled with a ground engaging output portion to support and propel the frame;

a torque converter driving the ground engaging output portion, adapted for variably transferring motive power from the motor to the transmission;

a lubrication circuit for providing lubrication fluid to the torque converter;

a control valve fluidly coupled between the torque converter and the lubrication circuit, adapted to controllably reduce the pressure of the lubrication fluid provided to the torque converter thereby reducing motive power transferred from the motor to the transmission;

a linkage movably attached to the frame to perform a work function;

an actuator adapted to controllably move the linkage;

a sensor coupled to the actuator to sense a force opposing the actuator;

a controller in communication with the sensor and the control valve, adapted to command a crowd reduction whereby the control valve controllably reduces the pressure of the lubrication fluid provided to the torque converter in response to the force opposing the actuator.

11. A work vehicle defined in claim 10 wherein transmission is a mechanical transmission.

12. A work vehicle defined in claim 10 comprising a command input device in communication with the controller, wherein the actuator controllably moves the linkage in proportion to operator manipulation of the command input device to a work position, and wherein the controller is precluded from commanding a crowd reduction unless the command input device is in a work position.

13. A work vehicle defined in claim 12 comprising an activation switch in communication with the controller, wherein the controller is precluded from commanding a crowd reduction unless the activation switch is engaged.

14. A work vehicle defined in claim 10 comprising an activation switch in communication with the controller, wherein the controller is precluded from commanding a crowd reduction unless the activation switch is engaged.

15. A work vehicle defined in claim 10 wherein the linkage comprising a loader boom pivotally attached to the frame, wherein the actuator comprising a boom hydraulic cylinder extending between the frame and the loader boom, adapted to variably move the loader boom, and a hydraulic circuit for controllably providing hydraulic fluid to the boom hydraulic cylinder thereby causing the boom hydraulic cylinder to move the loader boom, and wherein the sensor comprising a boom pressure sensor connected to the hydraulic circuit for sensing hydraulic pressure supplied to the boom hydraulic cylinder.

16. A work vehicle defined in claim 15 comprising a command input device in communication with the controller, wherein the hydraulic circuit provides hydraulic fluid to the boom hydraulic cylinder in proportion to operator manipulation of the command input device, and wherein the controller is precluded from commanding a crowd reduction unless the command input device is in a work position.

17. A work vehicle defined in claim 16 comprising an activation switch in communication with the controller, wherein the controller is precluded from commanding a crowd reduction unless the activation switch is engaged.

18. A work vehicle defined in claim 15 comprising an activation switch in communication with the controller, wherein the controller is precluded from commanding a crowd reduction unless the activation switch is engaged.

19. A work vehicle defined in claim 10 wherein the linkage comprising a loader boom pivotally attached to the frame, and a loader bucket pivotally attached to the loader boom, wherein the actuator comprising a bucket hydraulic cylinder extending between the loader boom and the loader bucket, adapted to variably move the loader bucket, and a hydraulic circuit for controllably providing hydraulic fluid to the bucket hydraulic cylinder thereby causing the bucket hydraulic cylinder to move the loader bucket, and wherein the sensor comprising a bucket pressure sensor connected to the hydraulic circuit for sensing hydraulic pressure supplied to the bucket hydraulic cylinder.

20. A work vehicle defined in claim 19 comprising a command input device in communication with the controller, wherein the hydraulic circuit provides hydraulic fluid to the bucket hydraulic cylinder in proportion to operator manipulation of the command input device, and wherein the controller is precluded from commanding a crowd reduction unless the command input device is in a work position.

21. A work vehicle defined in claim 20 comprising an activation switch in communication with the controller, wherein the controller is precluded from commanding a crowd reduction unless the activation switch is engaged.

22. A work vehicle defined in claim 19 comprising an activation switch in communication with the controller, wherein the controller is precluded from commanding a crowd reduction unless the activation switch is engaged.

23. A loader comprising:

a frame;

a motor supported by the frame;

a drive unit having a transmission operatively coupled with a ground engaging output portion to support and propel the frame;

a torque converter driving the ground engaging output portion, adapted for variably transferring motive power from the motor to the transmission;

a lubrication circuit for providing lubrication fluid to the torque converter;

a control valve fluidly coupled between the torque converter and the lubrication circuit, adapted to controllably reduce the pressure of the lubrication fluid provided to the torque converter thereby reducing motive power transferred from the motor to the transmission;

a loader boom pivotally attached to the frame;

a boom hydraulic cylinder extending between the frame and the loader boom, adapted to variably move the loader boom;

a hydraulic circuit for controllably providing hydraulic fluid to the boom hydraulic cylinder thereby causing the boom hydraulic cylinder to move the loader boom;

a boom pressure sensor connected to the hydraulic circuit for sensing hydraulic pressure supplied to the boom hydraulic cylinder;

a controller in communication with the boom pressure sensor and the control valve, adapted to command a crowd reduction whereby the control valve controllably reduces the pressure of the lubrication fluid provided to the torque converter in response to the pressure of the hydraulic fluid supplied to the boom hydraulic cylinder.

24. A loader defined in claim 23 wherein transmission is a mechanical transmission.

25. A loader defined in claim 23 comprising a command input device in communication with the controller, wherein the hydraulic circuit provides hydraulic fluid to the boom hydraulic cylinder in proportion to operator manipulation of the command input device, and wherein the controller is precluded from commanding a crowd reduction unless the command input device is in a work position.

26. A loader defined in claim 25 comprising an activation switch in communication with the controller, wherein the controller is precluded from commanding a crowd reduction unless the activation switch is engaged.

27. A loader defined in claim 23 comprising an activation switch in communication with the controller, wherein the controller is precluded from commanding a crowd reduction unless the activation switch is engaged.

28. A loader comprising:

a frame;

a motor supported by the frame;

a drive unit having a transmission operatively coupled with a ground engaging output portion to support and propel the frame;

a torque converter driving the ground engaging output portion, adapted for variably transferring motive power from the motor to the transmission;

a lubrication circuit for providing lubrication fluid to the torque converter;

a control valve fluidly coupled between the torque converter and the lubrication circuit, adapted to controllably reduce the pressure of the lubrication fluid provided to the torque converter thereby reducing motive power transferred from the motor to the transmission;

a loader boom pivotally attached to the frame;

a loader bucket pivotally attached to the loader boom;

a bucket hydraulic cylinder extending between the loader boom and the loader bucket, adapted to variably move the loader bucket;

a hydraulic circuit for controllably providing hydraulic fluid to the bucket hydraulic cylinder thereby causing the bucket hydraulic cylinder to move the loader bucket;

a bucket pressure sensor connected to the hydraulic circuit for sensing hydraulic pressure supplied to the bucket hydraulic cylinder;

a controller in communication with the bucket pressure sensor and the control valve, adapted to command a crowd reduction whereby the control valve controllably reduces the pressure of the lubrication fluid provided to the torque converter in response to the pressure of the hydraulic fluid supplied to the bucket hydraulic cylinder.

29. A loader defined in claim 28 wherein transmission is a mechanical transmission.

30. A loader defined in claim 28 comprising a command input device in communication with the controller, wherein the hydraulic circuit provides hydraulic fluid to the bucket hydraulic cylinder in proportion to operator manipulation of the command input device, and wherein the controller is precluded from commanding a crowd reduction unless the command input device is in a work position.

31. A loader defined in claim 30 comprising an activation switch in communication with the controller, wherein the controller is precluded from commanding a crowd reduction unless the activation switch is engaged.

32. A loader defined in claim 28 comprising an activation switch in communication with the controller, wherein the controller is precluded from commanding a crowd reduction unless the activation switch is engaged.

* * * * *